US007094145B2

(12) United States Patent
Rye et al.

(10) Patent No.: US 7,094,145 B2
(45) Date of Patent: Aug. 22, 2006

(54) VENT BAFFLE AND METHOD OF INSTALLATION

(75) Inventors: Palle Rye, Shillington, PA (US); Dave Rosten, Cambridge, MN (US); Richard L. Partlow, Jr., Reading, PA (US); Matt Kortuem, Blandon, PA (US)

(73) Assignee: Brentwood Industries, Inc., Reading, PA (US)

( * ) Notice: Subject to any disclaimer, the term of this patent is extended or adjusted under 35 U.S.C. 154(b) by 0 days.

(21) Appl. No.: 10/811,632

(22) Filed: Mar. 29, 2004

(65) Prior Publication Data

US 2005/0215192 A1 Sep. 29, 2005

(51) Int. Cl.
*F24F 7/02* (2006.01)

(52) U.S. Cl. ..... 454/366; 454/365; 52/95

(58) Field of Classification Search ..... 454/260, 454/261, 364, 365, 366; 52/94, 95, 198, 52/199

See application file for complete search history.

(56) References Cited

U.S. PATENT DOCUMENTS 3,863,553 A 2/1975 Koontz
4,096,790 A 6/1978 Curran
4,189,878 A * 2/1980 Fitzgerald ..... 52/95
4,214,510 A 7/1980 Ward
4,223,489 A 9/1980 Bentley
4,265,060 A 5/1981 Woodhams
4,581,861 A 4/1986 Eury
4,660,463 A * 4/1987 Bottomore et al. ..... 454/260
5,007,216 A 4/1991 Pearson
5,238,450 A * 8/1993 Rotter ..... 454/260
5,341,612 A 8/1994 Robbins
5,596,847 A 1/1997 Stephenson
5,600,928 A 2/1997 Hess et al.
5,697,842 A * 12/1997 Donnelly ..... 454/365
6,346,040 B1 2/2002 Best
6,357,185 B1 * 3/2002 Obermeyer et al. ..... 52/95

* cited by examiner

*Primary Examiner*—Derek S. Boles
(74) *Attorney, Agent, or Firm*—Akin Gump Strauss Hauer & Feld, LLP

(57) ABSTRACT

A single-piece vent baffle and method of installing a vent baffle. The vent baffle includes a main body portion and a tail portion and a first face and a second face. The main body portion includes at least one spacer extending from the first face. The vent baffle may be installed to an underside of a roof and to a wall plate by positioning the spacer adjacent the underside of the roof to create an air flow channel between the underside of the roof and the first face. The vent baffle blocks an opening between the roof and the wall plate while allowing ventilating air to flow through the air flow channel.

20 Claims, 7 Drawing Sheets

VENT BAFFLE AND METHOD OF INSTALLATION

TITLE OF THE INVENTION

Vent Baffle and Method of Installation

BACKGROUND OF THE INVENTION

The invention is in the field of building construction materials and particularly relates to attic vent baffles commonly used in residential building structures to allow ventilation flow through eave soffit vents into an attic space.

It is known in the prior art to provide attic ventilation systems to properly ventilate the attic space often found in residential buildings. Ventilation of the attic space is desirable to help prevent formation of condensation along the interior surface of the roof, which can damage attic insulation and the building structure itself. Proper ventilation also helps to prevent premature melting of snow accumulated on a building roof. Such premature melting can lead to the formation of ice on the roof. Such ice formations can be both a safety hazard and can also lead to roof damage.

Known attic ventilation systems typically comprise a plurality of vents located in the underside, or soffit, of eaves extending from the building roof. Typically, air travels through the soffit vents into the attic space via an opening (herein referred to as the "roof-wall plate opening") between the underside of the roof deck and the top of the exterior wall of the building (the so-called "wall plate") and subsequently through an air flow channel formed by a vent baffle disposed adjacent the underside of the roof deck. Ventilation flow typically exits from the air flow channel into the attic space. The attic space may be provided with a separate roof vent to facilitate flow of air from the attic space to the outdoors.

An attic ventilation system directs and controls the ventilation air flow, as otherwise uncontrolled air currents can be sufficiently strong to disturb placement of attic insulation, blowing the insulation about to create areas which are not properly insulated. Uncontrolled air currents circulating in the attic space can also negatively affect performance of the attic insulation by promoting increased convective heat transfer along the top surface of the insulation.

An attic ventilation system also accommodates installation of attic insulation over the entire ceiling, as nearly as possible up to the roof-wall plate opening. To do this, ventilation systems preferably make some provision to block intrusion of insulation into the interior space of the eaves (such intrusion could lead to blockage of the soffit vents) while also providing an air flow channel to permit and control air flow through the soffit vents into the attic space.

Known attic ventilation systems include that described by U.S. Pat. No. 6,357,185 (Obermeyer et al.). Obermeyer et al. discloses a rafter air infiltration block used in conjunction with a conventional roof vent board. The block of Obermeyer et al. is a generally rectangular sheet of material having a plurality of tabs connected to a remainder of the sheet by a plurality of fold lines. The block of Obermeyer et al. serves to prevent intrusion of insulation disposed proximate the roof-wall plate opening into the eave interior space, while the roof vent board provides an air flow channel to allow and control air flow from the soffit vents into the attic space. Installation of a roof ventilation system in accordance with the invention of Obermeyer et al. requires installation of a roof vent board, as well as separate installation of the separate block component. Installation of the block component of Obermeyer et al. requires that the installer fold the block component along multiple fold lines. The installation process is thereby complicated by the need to install two separate components and also by the need to fold the block component along multiple fold lines.

U.S. Pat. No. 6,346,040 (Best) discloses a ventilation panel comprising a rectangular sheet divided by a plurality of fold lines into a rectangular central portion, a pair of side edge portions and an end portion. When the side edge portions and end portions are folded into place, the ventilation panel of Best forms both an airflow channel and a roof-wall plate opening block. In order to install the ventilation panel of Best, it is necessary that the sheet be cut and folded at multiple locations, thus necessitating a relatively complicated and time-consuming installation process.

U.S. Pat. No. 4,581,861 (Eury) discloses a baffle board having side tabs and an end tab, each of the tabs being connected to a remainder of the baffle board by either perforated lines or score lines along which the tabs are bent relative to the remainder of the baffle board. Similar to the ventilation panel of Best, when the baffle board of Eury is folded into an installation configuration, the baffle board forms both an air flow channel and a roof-wall plate opening block. In order to install the baffle board of Eury, it is thus necessary to fold the board along multiple lines. It is further necessary for the installer to exercise judgment regarding the proper positioning of the baffle board (compare FIGS. 4 and 5 of Eury, which illustrate that an installer would be required to judge both the proper spacing of the baffle board from the underside of the roof deck and the proper angle of the baffle board relative to the roof).

There is a need for a vent baffle that is inexpensively manufactured, effectively provides ventilation and insulation baffling, is quickly and easily installed, and that may be installed in a wide range of building configurations. The present invention satisfies this need.

BRIEF SUMMARY OF THE INVENTION

Briefly stated, in a first aspect the invention is a single-piece vent baffle attachable to an underside of a roof and to a wall plate of a building structure. The vent baffle comprises a single-piece, unitary body, having a first face and a second face and a first end and a second end. A main body portion is proximate the first end. The main body has at least one spacer extending in a first direction from the first face. A tail portion is connected to the main body portion and is proximate the second end. The tail portion includes a flange disposed at the second end, the flange being connected to a remainder of the tail portion by a preformed bend. The main body portion is adapted to be fixedly attached to the underside of the roof, such that the spacer is positioned adjacent the underside of the roof, creating at least one air flow channel between the first face and the underside of the roof. The flange is adapted to be fixedly attached to the wall plate.

In a second aspect, the invention is a single-piece vent baffle attachable to an underside of a roof and to a wall plate of a building structure. The vent baffle comprises a single-piece, unitary body, having a first face and a second face and a first end and a second end. A main body portion is connected to the tail portion. The main body has at least one end spacer proximate the first end. A tail portion is proximate the second end. The main body portion is adapted to be fixedly attached to the underside of the roof, such that at least the end spacer is positioned adjacent the underside of the roof, creating at least one air flow channel between the first face and the underside of the roof. A portion of the tail portion is adapted to be fixedly attached to the wall plate.

In a third aspect, the invention is a single-piece vent baffle attachable to an underside of a roof and to a wall plate of a building structure. The vent baffle comprises a single-piece, unitary body, having a first face and a second face and a first end and a second end. A main body portion is proximate the first end and has a first spacer extending in a first direction from the first face. A tail portion is connected to the main body portion and is proximate the second end and includes a flange disposed at the second end. The flange is connected to a remainder of the tail portion by a preformed bend. The vent baffle further comprises a single flexible hinge connecting the main body portion and the tail portion. The main body portion is adapted to be fixedly attached to the underside of the roof, such that the spacer is positioned adjacent the underside of the roof, creating at least one air flow channel between the first face and the underside of the roof. A portion of the tail portion is adapted to be fixedly attached to the wall plate.

In yet a fourth aspect, the invention is a method of installing a vent baffle to an underside of a roof and to a wall plate of a building structure. The method comprises a first step (a) of providing a vent baffle. The vent baffle includes a single-piece, unitary body, having a first face and a second face, and a first end and a second end. A main body portion is proximate the first end and has at least one spacer extending from the first face. A tail portion is connected to the main body portion and is proximate the second end. The tail portion has a flange disposed at the second end, the flange being connected to a remainder of the tail portion by a preformed bend. The vent baffle further includes a single flexible hinge connecting the main body portion and the tail portion. In a second step (b), the vent baffle is positioned such that the spacer is adjacent the underside of the roof, between adjacent roof rafters, creating at least one air flow channel between the underside of the roof and the first face. A portion of the tail portion is adjacent the wall plate. The tail portion is angled relative to the main body portion at the hinge such that the vent baffle substantially blocks an opening located between the wall plate and the roof. In a third step (c), the tail portion is secured to the wall plate and the main body portion is secured to the underside of the roof.

BRIEF DESCRIPTION OF THE SEVERAL VIEWS OF THE DRAWINGS

The following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
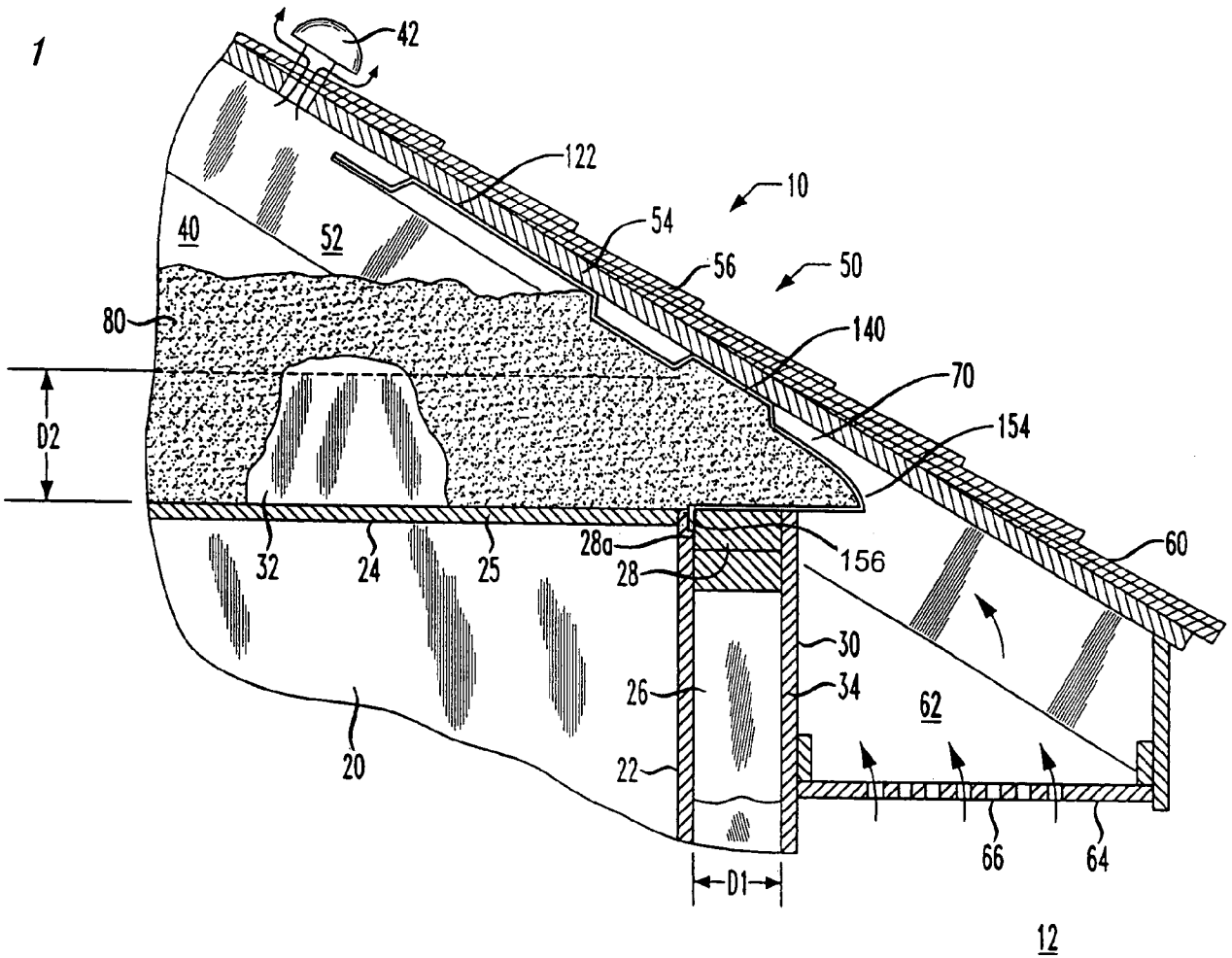
FIG. 1 is a vertical sectional view through a roof, wall and ceiling of a building structure, showing a vent baffle in accordance with one preferred embodiment of the present invention in an installed configuration to block a roof-wall plate opening of a first size.

Certain terminology is used in the following description for convenience only and is not limiting. The words "right", "left", "top", and "bottom" designate directions in the drawings to which reference is made. The words "interior" and "exterior" refer to directions towards and away from, respectively, the geometric center of the vent baffle or designated parts thereof. Furthermore, as used herein, the article "a" or a singular component includes the plural or more than one component, unless specifically and explicitly restricted to the singular or a single component or unless a singular meaning is apparent from the context. The terminology includes the words above specifically mentioned, derivatives thereof and words of similar meaning.

Referring to the drawings, wherein like reference numerals are used to designate the same components throughout the figures, there is shown in FIGS. 1–7 two preferred, non-limiting embodiments of a vent baffle 100. The vent baffle 100 is attachable to an underside of a roof deck 54 and to a wall plate 28 of a building structure 10.

Figure 2:
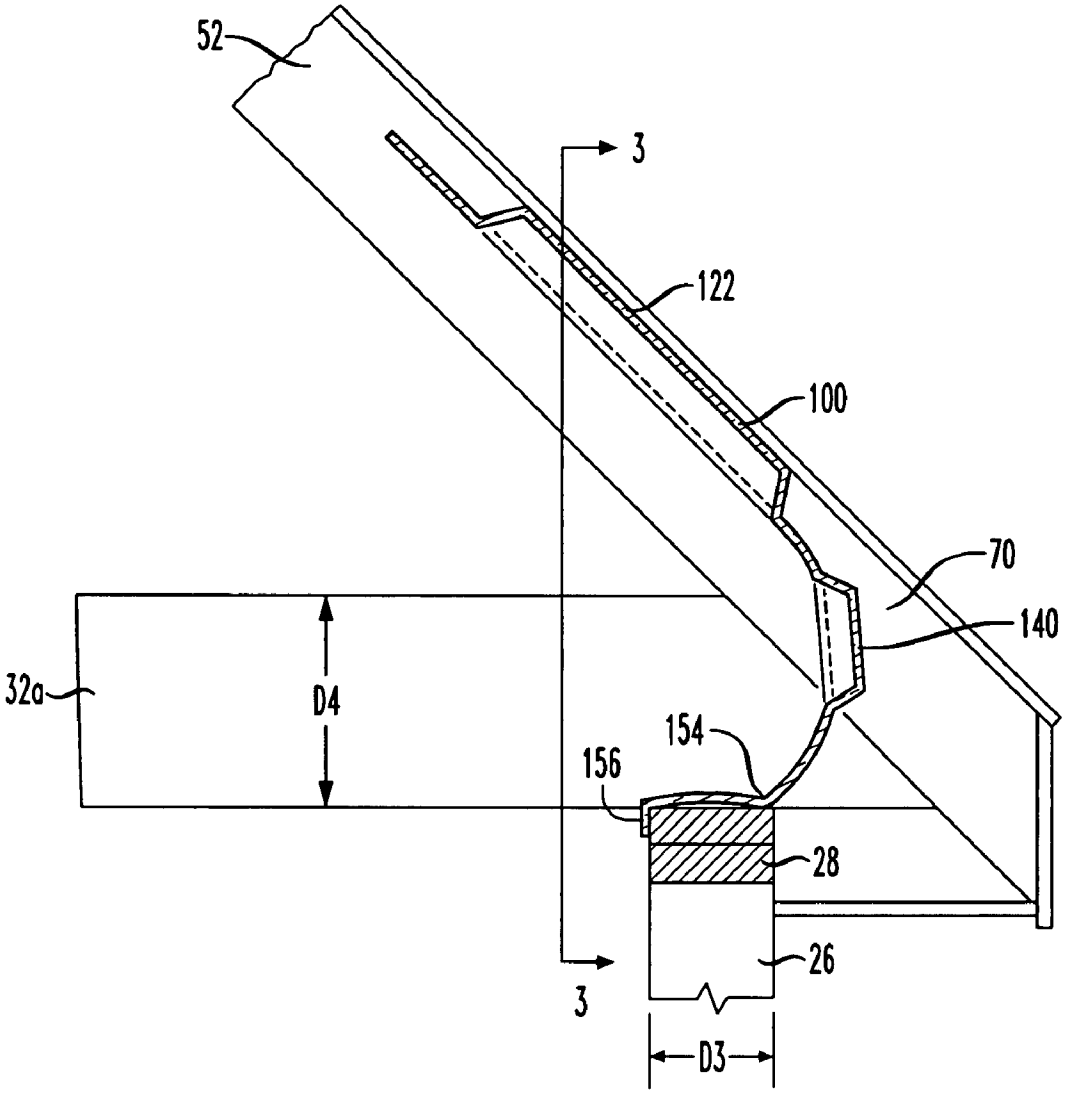
FIG. 2 is a vertical sectional view through a roof, wall and ceiling of a building structure, showing the vent baffle of FIG. 1 in an installed configuration to block a roof-wall plate opening of a second size.
Figure 3:
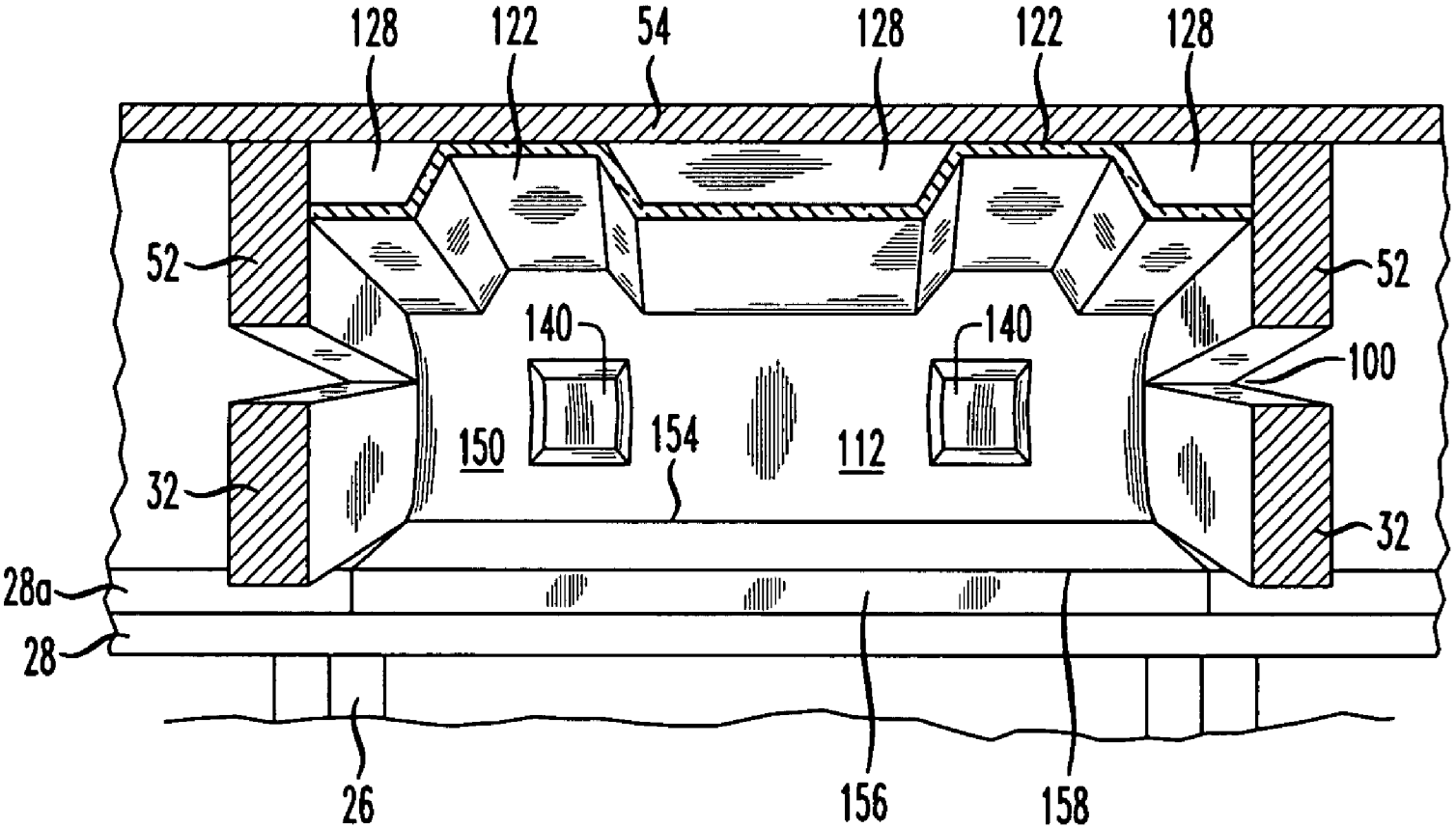
FIG. 3 is an interior perspective view of the vent baffle of FIGS. 1 and 2, oriented toward an exterior of the building structure and taken along line 3—3 of FIG. 2.

With particular reference to FIGS. 1–3, the building structure 10 is of conventional construction, and includes an interior room 20, an attic space 40, and a roof structure 50. The interior room 20 has an exterior wall 30 preferably formed by an assembly of interior wall board 22, wall studs 26 and an exterior wall covering 34 (a variety of well-known conventional materials including wood, vinyl or brick may be used for the exterior wall covering 34). The exterior wall 30 separates the interior room 20 from the outdoors 12. The wall plate 28 forms a top portion of the exterior wall 30. The interior room 20 further includes a ceiling 24 formed by ceiling wall boards 25 attached to ceiling joists 32. The ceiling joists 32 also function as attic floor joists. Typically, insulation 80 is installed over the ceiling 24 to insulate the interior room 20 of the building structure 10.

The roof structure 50 includes the roof deck 54 attached to roof rafters 52. Shingles 56 are attached to the roof deck 54. The roof rafters 52 and ceiling joists 32 may be supplied as a pre-assembled roof truss assembly or alternatively may be assembled at the construction site. The roof structure 50 preferably includes eaves 60 extending beyond the exterior wall 30. The eaves 60 include an interior space 62 and an underside, or "soffit" 64. The eave interior space 62 is vented to the outdoors 12 by soffit vents 66.

Sets of the roof rafters 52 and ceiling joists 32 connect together with the wall plate 28, typically at a spacing of two feet between adjacent sets of roof rafters 52 and ceiling joists 32. The roof-wall plate opening 70 is formed between adjacent sets of roof rafters 52 and ceiling joists 32. This roof-wall plate opening 70 may vary in size, depending upon size of the ceiling joists 32, size of the roof rafters 52, the spacing of the ceiling joists 32 and roof rafters 52 (typically 24 inches) and arrangement of the connection between the ceiling joists and roof rafters. For example, a ceiling joist 32 having a first height D2 is illustrated in FIG. 1, while a ceiling joist 32*a* having a height D4 (larger than D2) is illustrated in FIG. 2. The roof-wall plate opening 70 corresponding to ceiling joist 32 is smaller than the roof-wall plate opening 70 corresponding to ceiling joist 32*a*. Note further that the width of the wall plate 28 may vary, with the wall plate 28 (and wall studs 26) having a first width D1 (for example, D1 corresponding to the width of conventional 2" by 4" lumber) (FIG. 1) or having a second width D3 (for example, D3 corresponding to the width of conventional 2" by 641 lumber) (FIG. 2). Furthermore, the pitch of the roof 50 may vary from building structure 10 to another.

As discussed above, it is desirable to provide ventilation from the outdoors 12, through the soffit vents 66, into the eave interior space 62, through the roof-wall plate opening 70 and into the attic space 40, as depicted by the directional arrows in FIG. 1. The attic 40 may be provided with a passive or motor-driven fan vent 42 to increase and/or control the rate of ventilation flow.

With reference now primarily to FIGS. 1–6, the vent baffle 100 comprises a single-piece, unitary body, having a first face 110 and a second face 112. The vent baffle 100 has a first end 102 and a second end 104. A central longitudinal axis 101 extends between the first and second ends 102, 104. A main body portion 120 is proximate the first end 102, and has at least one, and preferably two elongated end spacers 122 extending in a first direction from the first face 110. Preferably, the end spacers 122 are closer to the first end 102 than the second end 104. A tail portion 150 is connected to the main body portion 120, and is proximate the second end 104. Preferably, the tail portion 150 is connected to the main body portion 120 by a single flexible hinge 154. As described in detail below, when the vent baffle 100 is installed in the building structure 10, it is necessary, for the embodiment of the vent baffle 100 shown in FIGS. 1–6, that the installer bend the vent baffle 100 along this single hinge 154.

Figure 6:
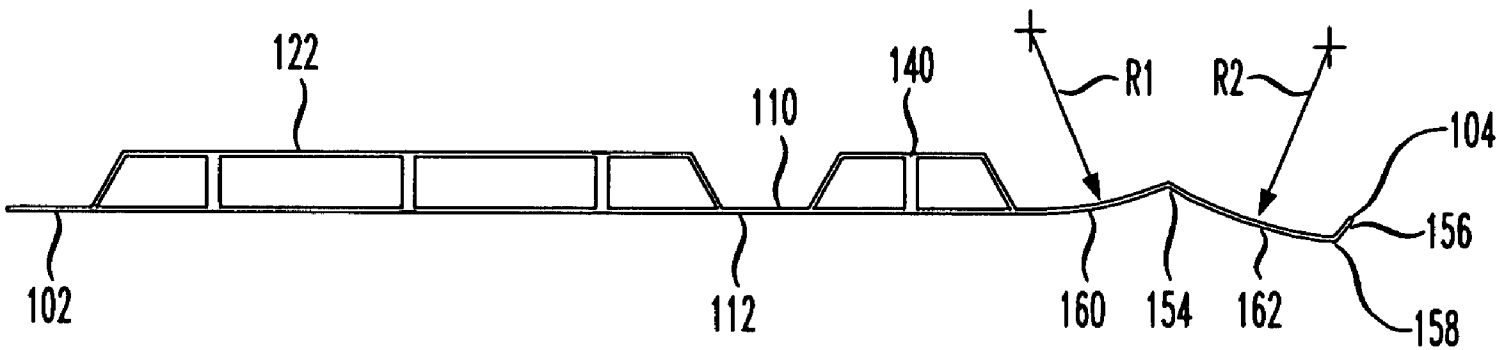
FIG. 6 is a side elevational view of the vent baffle of FIG. 4.

In one preferred embodiment, the hinge 154 is formed by an intersection of two preformed radiused sections 160 and 162. More particularly, as is best illustrated in FIG. 6, an end of the main body portion 120 extending toward the second end 104 includes a first radiused section 160, formed along a radius R1 located with respect to the side of the vent baffle corresponding to the first face 110. A second radiused section 162 extending between the first radiused section 160 and the second end 104 follows a radius R2 also located with respect to the first face 110 side of the vent baffle 100. The hinge 154 is not scored, cut or perforated. The vent baffle 100 has substantially the same thickness in the main body portion 120, the tail portion 150 and at the hinge 154.

Preferably, the tail portion 150 has a flange 156 disposed at the second end 104, the flange 156 being connected to a remainder of the tail portion 120 by a preferably single preformed bend 158. Preferably, the preformed bend forms an angle in the range of about 70 to about 110 degrees between the flange 156 and the remainder of the tail portion 150 (the angle being measured along the first face 110). Like the hinge 154, the bend 158 is not scored, cut or perforated and the bend 158 has substantially the same thickness as other portions of the vent baffle 100.

With particular reference to FIGS. 1–3, the main body portion 120 is adapted to be fixedly attached to the underside of the roof deck 54, such that the end spacer 122 is positioned adjacent the underside of the roof deck 54, creating at least one air flow channel 128 between the first face 110 and the underside of the roof deck 54. In the preferred embodiment illustrated, having two end spacers 122, there are three air flow channels 128, an air flow channel disposed along first and second sides edges 106 and 108 of the vent baffle 100 between the spacers 122 and the roof rafters 52, and one disposed between the two end spacers 122. Furthermore, the flange 156 is adapted to be fixedly attached to the wall plate 28, preferably along an interior side 28*a* of the wall plate 28.

The main body portion 120 may further comprise at least one, and preferably two, intermediate spacers 140 disposed between the end spacers 122 and the tail portion 150. Like the end spacers 122, the intermediate spacers 140 extend in the first direction from the first face 110. When the vent baffle 100 is installed in a first installation configuration as shown in FIG. 1, wherein the roof-wall plate opening 70 is relative small, without the tail portion 150 sagging inwardly away from the roof deck 54, the intermediate spacers 140 enhance the function of the end spacers 122 by bearing against the underside of the roof deck 54. In some installations, the intermediate spacers 140 may act as stiffeners in the direction of the longitudinal axis 101 of the vent baffle 100. In such installations, the intermediate spacers 140 tend to force the vent baffle 100 into a "bowed out" second installed configuration as shown in FIG. 2 when the vent baffle 100 is installed in a building structure 10 having a relatively large roof-wall plate opening 70. Thus, the intermediate spacers 140 tend to position the vent baffle 100 into the desired installed position, irrespective of the particular dimensions of the roof-wall plate opening 70 of the building structure 10.

Figure 4:
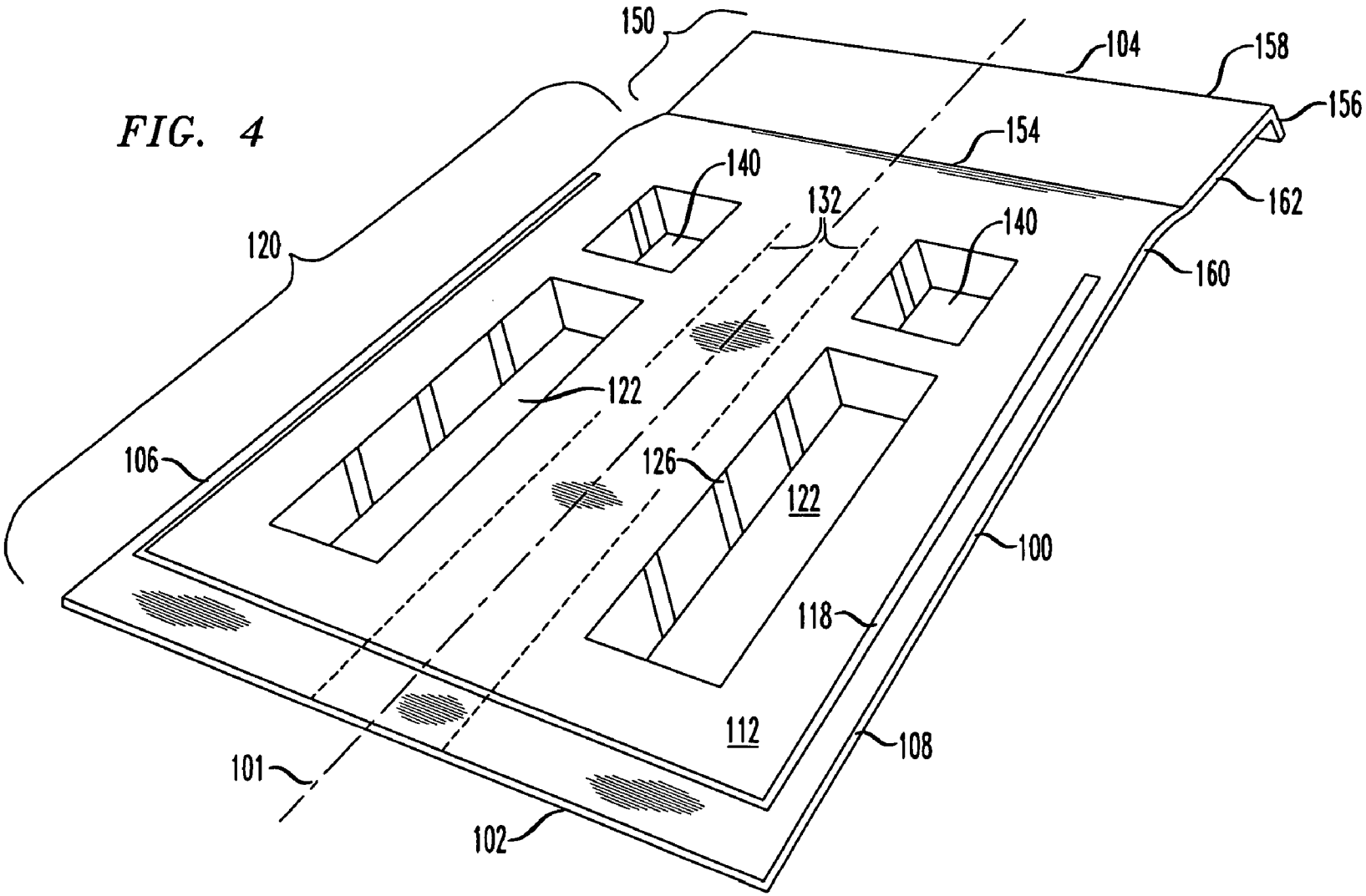
FIG. 4 is a perspective view of a first face of the vent baffle of FIGS. 1 and 2, shown in an uninstalled configuration.
Figure 5:
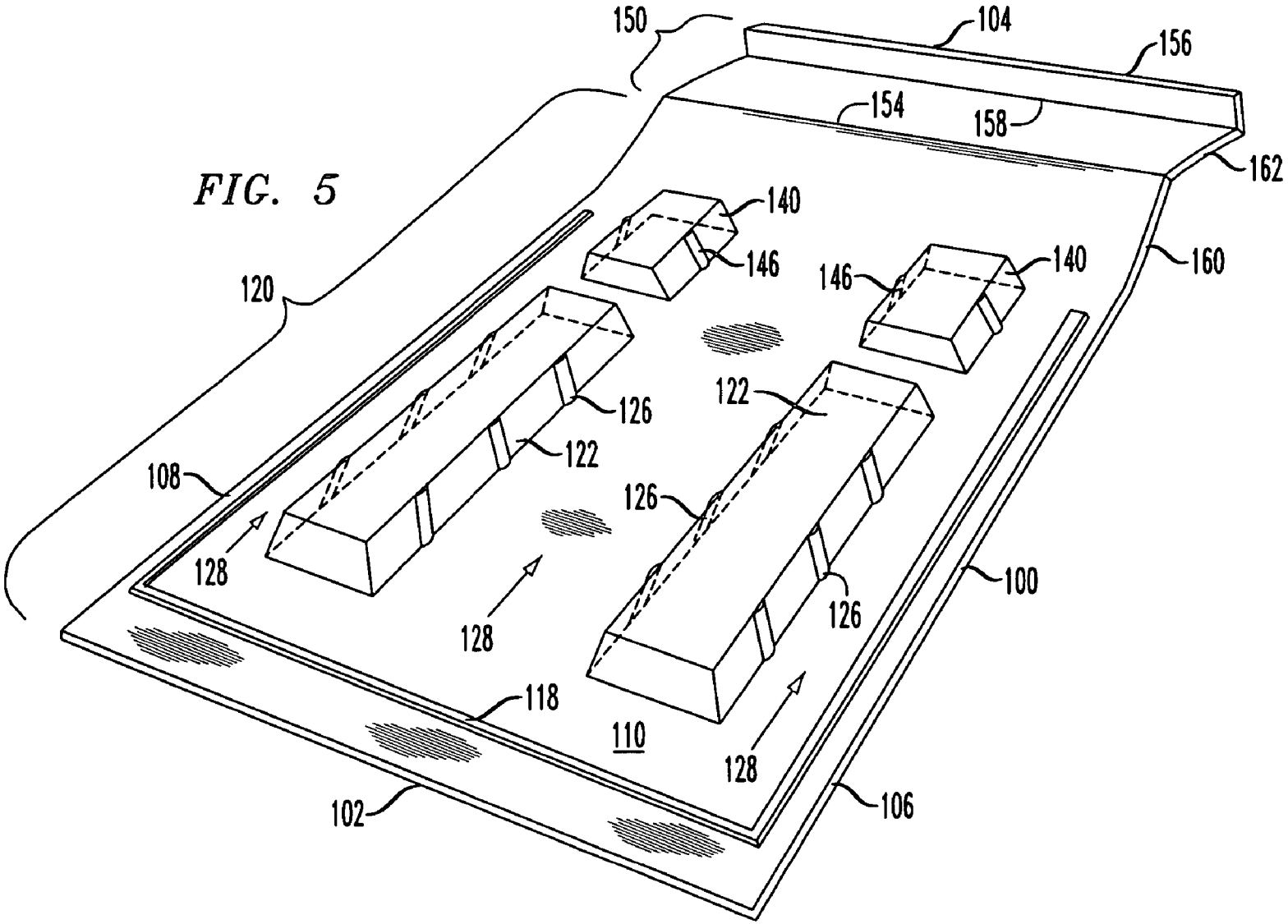
FIG. 5 is a perspective view of a second face of the vent baffle of FIG. 4.
Figure 7:
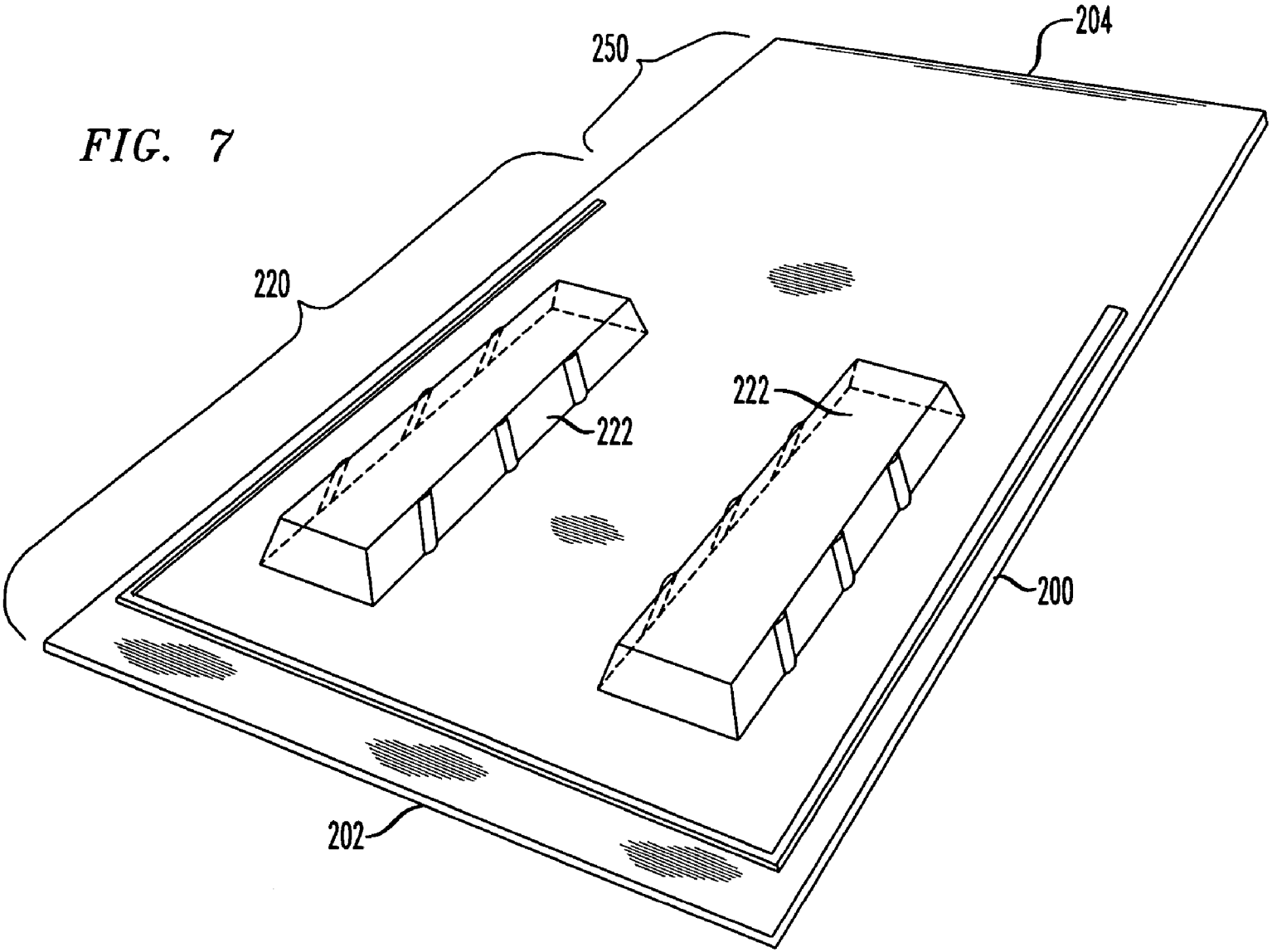
FIG. 7 is a perspective view of another embodiment of the present invention, shown in an uninstalled configuration.

An edge stiffener 118, shown only in the embodiments illustrated in FIGS. 4, 5 and 7, optionally, but preferably, may be disposed along at least one of the first end 102 and portions of the two side edges 106, 108, and is preferably disposed along each of the first end 102 and portions of the side edges 106, 108 proximate the first end 102. Similarly, the end spacers 122 and intermediate spacers 140 may further comprise at least one, and preferably a plurality, of side stiffeners 126, 146, respectively. In the preferred embodiment, the side stiffeners 126, 146 are formed unitarily with the end and intermediate spacers 122, 140, respectively, by conventional thermal forming or molding techniques.

The vent baffle 100 is a flexible sheet preferably having a thickness of about 0.010 inch to about 0.040 inch. Sheet metals, thermoplastics, and composite materials composed of fibers impregnated with thermoplastic materials can all be used to form the vent baffle 100. Sheet metals such as galvanized steel, stainless steel, aluminum and copper can be formed into vent baffles for use in the present invention. Thermoplastic materials which can be used in the present invention are, for example, polyvinyl chlorides (plasticized or unplasticized), polystyrenes, acetals, nylons, acrylonitrile-butadiene-styrene (ABS), styrene-acrylonitrile (SAN), polyphenylene oxides, polycarbonates, polyether sulfones, polyaryl sulfones, polyethylene, polystyrene, terephthalates, polyetherketones, polypropylenes, polysilicones, polyphenylene sulfides, polyionomers, polyepoxides, polyvinylidene halides, and derivatives and/or mixtures thereof. The particular material used is dependent upon the desired end use and the application conditions associated with that use, as is well known in the art. Presently it is preferred that a synthetic polymer, such as polyvinylchloride, polypropylene, ABS, or polystyrene, be used to form the vent baffle 100.

The vent baffle 100 is preferably fabricated using conventional thermal forming techniques well known in the art of molding. From this disclosure, the artisan will recognize that the geometrical design of the vent baffle 100 allows a simple one-step manufacturing process, reducing the cost of fabrication. The artisan will further recognize from this disclosure that multiple vent baffles 100 may be stacked on top of one another in a nested arrangement for storage and shipment, facilitating transport of the vent baffles 100.

Optionally, the vent baffle 100 may be provided with one or more score lines 132 (best seen in FIG. 4) extending over at least a portion of the main body 120 to facilitate cutting the vent baffle 100 into smaller portions for installation between adjacent sets of roof rafters 52 and ceiling joists 32 having less than the two foot standard spacing.

In use, the vent baffle 100 of the present invention is installed to the underside of the roof deck 54 and to the wall plate 28 in accordance with a method comprising three steps. In a first step the user provides a vent baffle 100 as described above. In a second step, the vent baffle 100 is positioned such that the spacer 122 is adjacent the underside of the roof deck 54, between adjacent roof rafters 52, creating at least one air flow channel 128 between the underside of the roof deck 54 and the first face 110. A portion of the tail portion 150 is adjacent the wall plate 28 and the tail portion 150 may be angled relative to the main body portion 120 at the hinge 154 such that the vent baffle 100 substantially blocks the roof-wall plate opening 70. This forms the baffle for channeling air flow from the soffit vents 66 into the attic space 40, while also retaining the insulation 80 within the attic space 40 such that the insulation 80 does not block the air flow. The vent baffle 100 may be very readily placed in the proper position for installation, irrespective of the exact dimensions of the building structure 10 into which the vent baffle 100 is being installed. More particularly, with reference again to FIGS. 1–3, it is not necessary that the installer gauge the position of the vent baffle 100 relative to the underside of the roof deck 54 in order to obtain an air flow channel 128 of the appropriate size. That is, the spacer 122 automatically positions the first face 110 at the proper distance from the underside of the roof deck 54.

Similarly, the flange 156 and hinge 154 aid in properly placing the vent baffle 100 relative to the wall plate 28 and roof deck 54. More particularly, when the flange 156 overlaps a portion of the interior side 28*a* of the wall plate 28, and the second radiused portion 162 is positioned adjacent a top of the wall plate 28, the main body 120 tends to position itself relative to the roof deck 54 and wall plate 28 in the proper position along the longitudinal axis 101 of the vent baffle 100, such that a full layer of insulation 80 can be installed over the entire ceiling 24. Accordingly, only minimal effort is required on the part of the installer to properly place the vent baffle 100 into the installation position.

In a third step, preferably the tail portion 150 is first secured to the wall plate 28 followed by the main body portion 120 being secured to the underside of the roof deck 54. Alternatively, the main body portion 120 could be secured to the underside of the roof deck 54 prior to the tail portion 150 being secured to the wall plate 28. Preferably, the main body portion 120 and the flange 156 are fixedly attached to the roof deck 54 and the interior side 28*a* of the wall plate 28, respectively, preferably using staples. Other mechanical fasteners or adhesive could also be used to attach the main body portion 120 and/or the flange 156.

Once the vent baffles 100 are installed, insulation 80 can then be installed in the attic space 40. Insulation 80 typically can be installed as batts laid between the ceiling joists 32 or by blowing loose insulation into the attic space 40. Blown-in insulation 80 is illustrated in FIG. 1.

With reference now to FIG. 7, another embodiment vent baffle 200 is similar to the first embodiment vent baffle 100 with the exception that the intermediate spacers 140, the hinge 154 and the flange 156 are omitted. The second embodiment vent baffle 200 functions in generally the same manner as the first embodiment 100 and may be manufactured using the same materials and manufacturing techniques. When installed, a main body portion 220 is not angled relative to a tail portion 250 in an abrupt manner at a hinge, but rather the tail portion 250 is an extension or continuation of the main body portion 220. The tail portion 250 is connected near a second end 204 to the wall plate 28.

From the foregoing it can be seen that the present invention comprises a vent baffle that is inexpensively manufactured, effectively provides ventilation and insulation baffling, is quickly and easily installed, and that may be installed in a wide range of building configurations.

It will be appreciated by those skilled in the art that changes could be made to the embodiment described above without departing from the broad inventive concept thereof. It is understood, therefore, that this invention is not limited to the particular embodiments disclosed, but it is intended to cover modifications within the spirit and scope of the appended claims.

We claim:

1. A single-piece vent baffle attachable to an underside of a roof and to a wall plate of a building structure, the vent baffle comprising a single-piece, unitary body, having:

a first face and a second face;

a first end and a second end;

a main body portion proximate the first end having at least one spacer extending in a first direction from the first face; and a tail portion connected to the main body portion and proximate the second end, having a flange disposed at the second end, the flange being connected to a remainder of the tail portion by a preformed bend, wherein:

the main body portion is adapted to be fixedly attached to the underside of the roof, such that the spacer is positioned adjacent the underside of the roof, creating at least one air flow channel between the first face and the underside of the roof, and the flange is adapted to be fixedly attached to an interior side of the wall plate.

2. The vent baffle of claim 1 wherein the preformed bend forms an angle of about 70 to 110 degrees between the flange and the remainder of the tail portion.

3. A single-piece vent baffle attachable to an underside of a roof and to a wall plate of a building structure, the vent baffle comprising a single-piece, unitary body, having:

a first face and a second face;

a first end and a second end;

a main body portion connected to the tail portion and having at least one end spacer proximate the first end; and a tail portion proximate the second end;

wherein:

the main body portion is adapted to be fixedly attached to the underside of the roof, such that the end spacer is positioned adjacent the underside of the roof, creating at least one air flow channel between the first face and the underside of the roof, and a portion of the tail portion is adapted to be fixedly attached to an interior side of the wall plate.

4. The vent baffle of claim 3 further comprising at least one intermediate spacer disposed between the end spacer and the tail portion, with both the end spacer and the intermediate spacer extending in a first direction from the first face.

5. A single-piece vent baffle attachable to an underside of a roof and to a wall plate of a building structure, the vent baffle comprising a single-piece, unitary body, having:

a first face and a second face;

a first end and a second end;

a main body portion proximate the first end having a first spacer extending in a first direction from the first face;

a tail portion connected to the main body portion and proximate the second end, having a flange disposed at the second end, the flange being connected to a remainder of the tail portion by a preformed bend; and a single flexible hinge connecting the main body portion and the tail portion, wherein:

the main body portion is adapted to be fixedly attached to the underside of the roof, such that the spacer is positioned adjacent the underside of the roof, creating at least one air flow channel between the first face and the underside of the roof and a portion of the tail portion is adapted to be fixedly attached to an interior side of the wall plate.

6. The vent baffle of claim 5 wherein the portion of the tail portion adapted to be fixedly attached to the wall plate is the flange.

7. The vent baffle of claim 5, the main body portion further comprising a second spacer extending in the first direction from the first face.

8. The vent baffle of claim 5 wherein the vent baffle is a flexible sheet.

9. The vent baffle of claim 8 wherein the sheet has a thickness of about 0.010 inch to about 0.040 inch.

10. The vent baffle of claim 5 wherein the vent baffle is fabricated from a synthetic polymeric material.

11. The vent baffle of claim 10 wherein the synthetic polymeric material is polyvinyl chloride.

12. The vent baffle of claim 5 further comprising a score line to facilitate cutting of the vent baffle.

13. The vent baffle of claim 5, the building structure having an opening between the underside of the roof and the wall plate, and the vent baffle having an installed condition wherein the first spacer fixedly attaches to the underside of the roof, the flange fixedly attaches to the wall plate and the tail portion substantially blocks the opening.

14. The vent baffle of claim 13 wherein the flange is attached to the wall plate along an interior side of the wall plate.

15. The vent baffle of claim 5, wherein the main body portion further comprises two opposing side edges and a stiffener disposed along at least one of the first end and the two side edges.

16. The vent baffle of claim 5 further comprising at least one stiffener formed unitarily with the first spacer.

17. A method of installing a vent baffle to an underside of a roof and to a wall plate of a building structure, the method comprising the steps of:

(a) providing a vent baffle including:

a single-piece, unitary body, having:

a first face and a second face, a first end and a second end, a main body portion proximate the first end having at least one spacer extending from the first face;

a tail portion connected to the main body portion and proximate the second end, having a flange disposed at the second end, the flange being connected to a remainder of the tail portion by a preformed bend; and a single flexible hinge connecting the main body portion and the tail portion;

(b) positioning the vent baffle such that:

the spacer is adjacent the underside of the roof, between adjacent roof rafters, creating at least one air flow channel between the underside of the roof and the first face;

a portion of the tail portion is adjacent the wall plate; and the tail portion is angled relative to the main body portion at the hinge such that the vent baffle substantially blocks an opening located between the wall plate and the roof; and (c) securing the flange to an interior side of the wall plate and the main body portion to the underside of the roof.

18. The vent baffle of claim 1 further comprising:

a radiused portion located between the tail portion and an end of the at least one spacer, the radiused portion being generally flexible to permit the vent baffle to adapt to various roof pitches.

19. The vent baffle of claim 18 further comprising:

an intermediate spacer disposed between the at least one spacer and the tail portion, a portion of the main body between the intermediate spacer and the at least one spacer being generally flexible to permit the vent baffle to adapt to the various roof pitches.

20. The vent baffle of claim 5 further comprising:

a radiused portion located between the tail portion and an end of the first spacer, the radiused portion being generally flexible to permit the vent baffle to adapt to various roof pitches.

* * * * *